United States Patent [19]

Pfister et al.

[11] 4,397,728

[45] Aug. 9, 1983

[54] DEVICE FOR CONDUCTING ELECTRIC CURRENT BETWEEN ELECTROLYTIC CELLS

[75] Inventors: Hans Pfister, Dübendorf; Otto Knaisch, Uerikon; Jean-Marc Blanc, Sierre, all of Switzerland

[73] Assignee: Swiss Aluminium Ltd., Chippis, Switzerland

[21] Appl. No.: 216,422

[22] Filed: Dec. 15, 1980

[30] Foreign Application Priority Data

Dec. 21, 1979 [CH] Switzerland ..... 11378/79

[51] Int. Cl.[3] ..... C25C 3/16

[52] U.S. Cl. ..... 204/243 M; 204/244

[58] Field of Search ..... 204/243 M, 244, 243 R, 204/246-247, 67

[56] References Cited

U.S. PATENT DOCUMENTS 3,969,213 7/1976 Yamamoto et al. ..... 204/243 M X
4,049,528 9/1977 Morel et al. ..... 204/243 M
4,090,930 5/1978 Morel et al. ..... 204/243 M
4,194,958 3/1980 Nebell ..... 204/243 M

*Primary Examiner*—Donald R. Valentine
*Attorney, Agent, or Firm*—Bachman and LaPointe

[57] ABSTRACT

A device for conducting the electric current from the cathode of a hooded, transverse electrolytic cell to the anode of a neighboring cell via cathodically polarized carbon blocks in the pot of a cell, cathode bars and individual conductor bars wherein the current from each cathode bar is passed under a cell to a compensating conductor bar which runs around the neighboring cell. This compensating conductor bar is connected to each anode of the cell it runs around via a flexible conductor strip. Each anode is provided on its uppermost side with a yoke which is inserted and firmly secured in place, together with the conductor strip, in a notch or recess provided in a device for holding the anode in place.

The anode holding device remains in place during anode changes and can be adjusted vertically by means of a motor or the like as a function of the voltage or the desired interpolar distance between anode and cathode.

13 Claims, 6 Drawing Figures

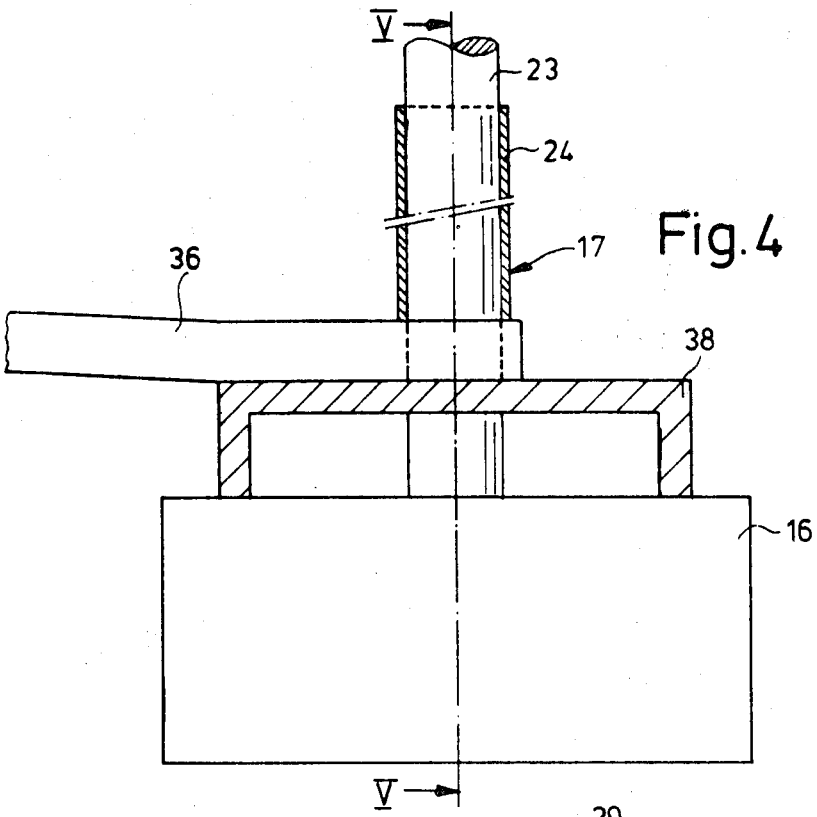
Fig.4
Fig.5
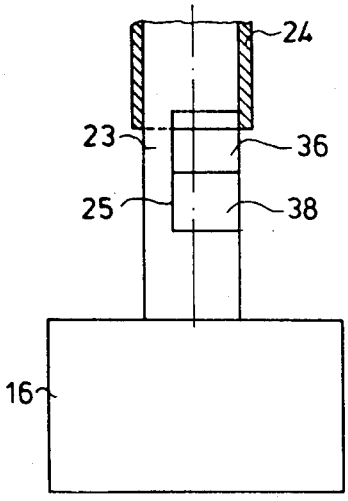
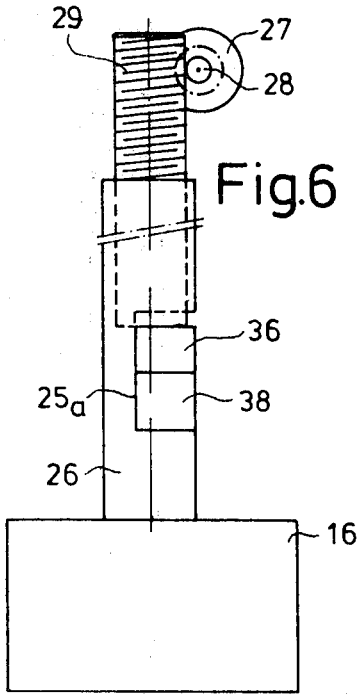
Fig.6

DEVICE FOR CONDUCTING ELECTRIC CURRENT BETWEEN ELECTROLYTIC CELLS

The present invention is drawn to a device for conducting electric current from the cathode of a, if desired, hooded and in particular transversely disposed electrolytic cell to the anodes of a neighboring electrolytic cell via cathodically polarized carbon blocks in a reduction pot, cathode bars and conductor bars (individual busbars).

Known busbar arrangements between two transverse electrolytic cells conduct the cell current from the cathode bars by means of collector conductor bars to the sides of the cell parallel to the cathode bars and from there to the neighboring cell via connecting busbars. As a rule the connecting busbars are connected to stationary or vertically movable risers on the neighboring cell so that the current is passed through these and then to the moveable or stationary anode beam of the cell. The current flows from the anode beam through the anode rods to the individual anodes.

The known devices allow for many different possibilities for the conductor path. For example the current from all the cathode bars can be collected in one single connector bar and conducted to the risers in the next cell. It is also known to conduct the current via one or two cathode bars under the cell containing these cathode bars and then directly to the anode beam of the neighboring cell.

The risers are positioned at the long or short sides of the cells depending on the arrangement of the busbars.

Such busbar arrangements suffer from significant disadvantages. The busbars which pass around the pot and the risers cause a large voltage drop, in particular when the cells are broad.

The risers situated at the long or short sides of the cell make it difficult to work on the cell, in particular the changing of the anodes. Also, on changing the anodes a loss of current occurs as there is no compensation in the current. Likewise, short circuiting cells always gives rise to difficulties.

Furthermore, the cathodically polarized collector bars have the disadvantage that, for purely practical reasons, they are not made in the optimum shape required by electrical theory. This leads to compensating currents in the collector bars and in the cathode this is the liquid bath. These compensating currents are undesired and affect the operation of the cell.

The same considerations with respect to this kind of interference also hold for the anode beam which acts as a current distributor.

In addition, the passage of current from the anode beam to the anodes produces considerable disadvantages. The work and expense involved in connecting the anode rod and anode in the anode preparation department, for example rod straightening, cleaning and welding and the transport is very large and the handling may lead to accidents. Furthermore, the anodes can be changed only along with their supporting rods, which again makes it more difficult to have a well sealed cell. The loss of current in the anode rod itself can also not be overlooked.

It is therefore the principal object of the invention to develop a device for conducting the electrical current between electrolytic cells such that the foregoing disadvantages are not experienced and in particular such that economic advantages are gained.

SUMMARY OF THE INVENTION

The foregoing object is achieved by way of the present invention wherein individual conductor bars are arranged under a cell and a neighboring cell such that the conductor bars under the first cell connect each of the cathode bars remote from the neighboring cell to the compensating conductor bar at the neighboring cell, and the conductor bars under the neighboring cell connect each of the cathode bars of the previous cell on the side adjacent to the said neighboring cell to the compensating conductor bar.

In this it is forseen that two cathode bars may be connected to one single conductor bar and in this way to the compensating conductor bar.

Thus the cell current is conducted from one cell to the next via the shortest, practically realizable route.

The individual conductor bars, which are equal in length and in cross section, produce a passage of current between the two cells with the same voltage drop, independent of whether each conductor bar connects up to one single conductor bar or whether two joined conductor bars on one long side of the cell always connect up with one single conductor bar.

In the whole conductor bar system the current flows in the longitudinal direction in the pot room, except for when a cell is short circuited out of the supply system. In practice it has been found that an electrolytic cell running with a current of about 160 kA and a busbar current density $j=0.3\ A/mm^2$ an energy savings of approximately 0.7 kWh/kg Al over the known busbar arrangement is achieved. This is indeed one of the most important advantages of the present invention.

For the same width of cell but different cell length (different cell sizes or levels of cell current) the voltage drop always remains the same.

The disadvantages of the compensating currents and their side effects on cell operation are not experienced with the new arrangement of busbars in accordance with the present invention.

Advantages in terms of magnetic effects acting on the bath are found due to the absence of the cathode collector bars at the long sides of the cell, the connecting rails at the short, transverse sides of the cell, the risers, in particular with respect to the concentration of cathode busbars at the corners of the cell and at the anode beam extending over the bath. In fact the metal bath is exposed to a uniform field which minimizes doming of the molten metal.

The device according to the invention has the following constructional advantages:

The individual conductor bars are of equal length and cross section, which leads to simplifications both in construction and for production.

Conducting the cell current by means of individual conductor bars under the cell results in small conductor bar cross sections. The arrangement of conductor bars according to the equation does not effect the possibilities for installing central, transverse or point-feeding facilities.

On changing anodes there is no hindrance due to fixed riser bars at the long sides or corners of the cell.

A cell which leaks at a bar exit point causes at most two individual conductor bars to be put out of use.

The withdrawal of metal from the cell is no longer made difficult due to risers at the ends of the cell.

To change a cathode it is only necessary to open the cathode bar connections by removing the anode before raising the anode part as the current supply to the anodic part is interrupted.

For a current of ca. 160 kA and a current density of $j=0.3\ A/mm^2$ in the conductor bars the conductor bars in accordance with the invention require only approximately 24 tons aluminum. This means a saving of up to 35% compared with the conventional arrangement because the cathodic collector bars on the long sides of the cell, the cathodic, connecting busbars on the transverse side of the cell, the risers on the long sides and/or short sides of the cell and or the cell corners are eliminated.

The above mentioned compensating conductor bar is preferably situated in the form of a ring around the cell at the height of the pot. Basically, the compensating conductor bar, as the name says, produces a compensating effect of irregularities in the electric current flowing. On changing the anodes it also directly affects the current compensation on the neighboring cells and, at the same time, serves as a compensating conductor for the cathode of the cell. Consequently there is no loss of current on changing anodes.

Furthermore, during the short circuiting of the neighboring cell, the compensating conductor serves as power supply conductor bar. It can also be used to support the working surface around the cell.

One of the most important advantages is that the compensating conductor bar makes possible the power connection with the anode via a flexible strip, this preferably being secured as close as possible to the anode. To this end the anode is, in accordance with the invention, usefully provided with a yoke which is connected to, but easily releasable from, the anode holding facility and the flexible strip.

When changing anodes only the butt of the consumed anode, together with the yoke, is removed from the anode holding device. This design of anode makes the transport of the anode to and from the anode preparation department much easier. The cause of frequent accidents in the past, that is the anode rods falling over, is eliminated. The handling of the anodes is as a whole made much easier.

The width of the anode itself is preferably chosen such that it is always double the width of a carbon block element. The cell current thus flows from two single conductor bars to one anode of the next cell.

This design of anode allows the anode holding device to be left on the cell and can, for example, be attached to the anode beam. This makes it possible to move the anode holding device vertically up and down by means of a motor, a hydraulic, pneumatic or the like power-driven system. The vertical movement corresponds, uniformly, to the consumption of the anode, so that the most favorable interpolar distance between anode and cathode is always maintained. This eliminates the measurement of anode position.

To control this vertical movement the inventor considers, in terms of the invention, a calculator/data processor which receives information on the current in the cathode and anode and compares these with ideal values. If the voltage exceeds a certain limiting value, the interpolar distance is decreased automatically by lowering the anode.

If the anode is fully consumed or down to the butt, a motor driven system causes the anode holding device to start moving vertically upwards, this process preferably being interrupted after the anode butt has been raised out of the crust on the bath. With hooded cells the crust therefore has time to close up again without fumes being released to the pot room. Only when the crust has completely closed off the gap caused by removing the anode butt is the butt raised further.

As the hooding of the pot, with this conductor bar arrangement and this design of anode holding facility can, to advantage, be very effectively sealed, environmental pollution due to waste gas can be reduced to a minimum. The hooding comprises preferably cover sheets hinged at the anode beam or the like, such that there is a cover sheet for each anode. By raising the anode butt this cover sheet is opened, while the rest of the cell still remains covered.

To change anodes, the flexible conductor strip is removed first and then the yoke raised from its place of attachment to the anode holding device.

There are many possibilities for the means of connecting the yoke and conductor strip to the anode holding device. The anode holder can for example comprise two elements which are coaxial and which can be moved one inside the other, such that one of these elements features a notch or recess in or over which the other element is moved, by means of which a clamping action is achieved.

If a holding rod features a recess into which the yoke on the anode and the conductor strip is introduced, it has been found advantageous to provide round the holding rod a clamping sleeve with a thread on its inside wall. After inserting the yoke and the flexible conductor strip this sleeve is moved over the recess by a rotating movement so that the yoke and strip are clamped in place.

Another possibility is to have a sleeve secured to the anode beam such that the sleeve features near the end remote from the anode beam a recess into which the yoke and the conductor strip are inserted. The yoke and strip are held in place by introducing an extrusion billet into the sleeve. The clamping sleeve or the extrusion billet can be moved preferably by pneumatic, hydraulic or mechanical means.

These above mentioned possibilities for connecting the anode to the anode holding device are however to be looked on simply as examples.

BRIEF DESCRIPTION OF THE DRAWINGS

Further advantages, details and features of the present invention will be apparent from the following description of the preferred exemplified embodiments with the help of the drawings viz., wherein

FIG. 4: A detail from FIG. 1.

FIG. 5: A cross section through the view shown in FIG. 4 along line V—V in that figure.

FIG. 6: A further version of the detail shown in FIG. 5.

DETAILED DESCRIPTION

Figure 1:
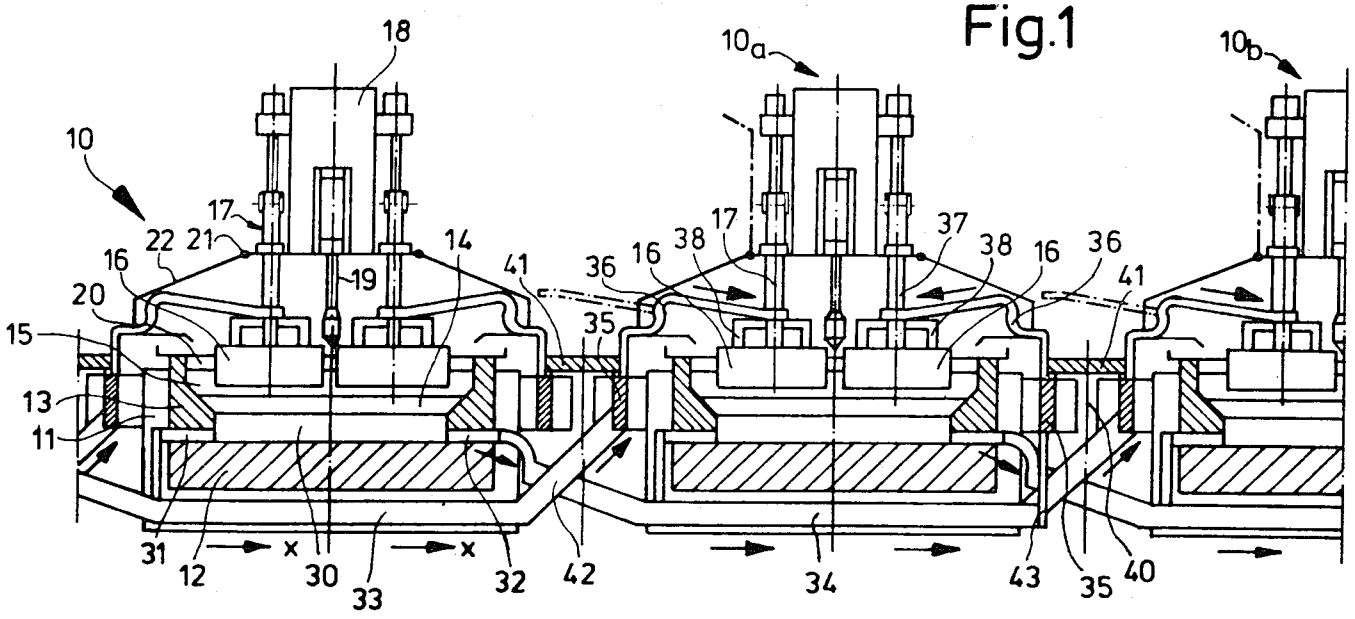
FIG. 1: A cross section through a row of transversely arranged electrolytic cells.
Figure 2:
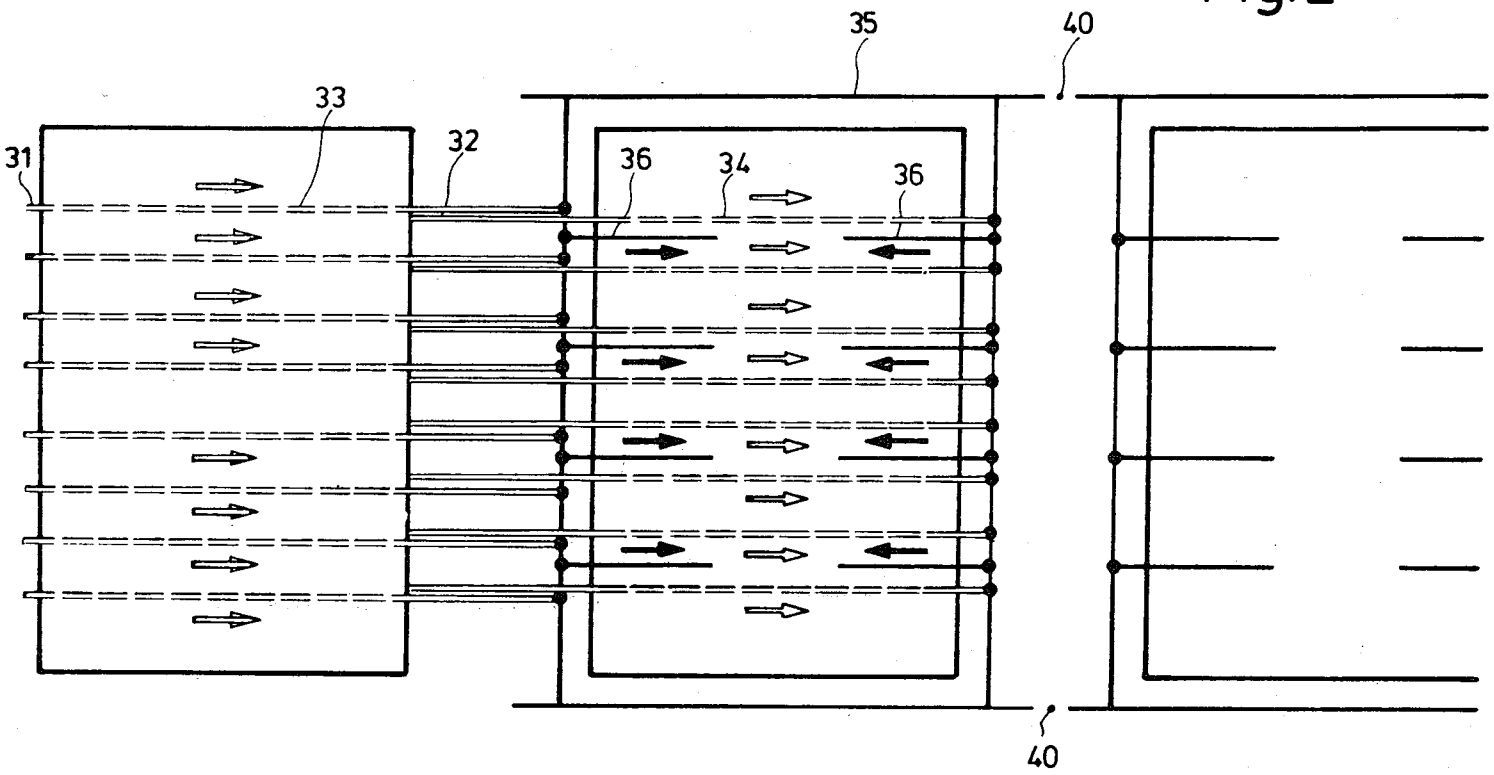
FIG. 2: A schematic representation of the passage of electric current between electrolytic cells.

A pot 11 of an electrolytic cell 10 is lined on its floor with insulating material 12 and at the sides with carbon blocks 13. On the insulating material 12 rest cathodically polarized carbon blocks 30 from which the electric current is conducted via cathode bars 31, 32 in direction x.

Aluminum 15 precipitated out of electrolyte 14 collects on the carbon blocks 30.

Dipping into the electrolyte 14 are anodes 16 which are secured to an anode beam 18 by anode holders 17.

Situated between neighboring anodes 16 is a device 19 for breaking open the crust 20 of solidified electrolyte.

The pot 11 is hooded and encapsulated by a cover sheet 22 which can be tilted about a piano type hinge 21 on the anode beam 18.

Individual conductor bars (busbars) 33, 34 connect up to the cathode bars 31, 32, such that the conductor bar 33 conducts the current in a cathode bar 31 remote from an electrolytic cell 10*a* under the cell 10 and conductor bar 34 leads the current from the cathode bar 32 near the cell 10*a* under cell 10*a*. This means that 50% of the current in a cathodically polarized carbon block 30 flows through each of the conductors 33, 34.

The conductor bars 33, 34 are connected at cell 10*a* to a compensating conductor 35 which circumvents cell 10*a*.

The busbar arrangement from the cathode of cell 10 to the compensating conductor 35 of cell 10*a* is made for each carbon block i.e. for each cathode bar 31, 32 in cell 10. If cell 10*a* is short circuited i.e. taken out of service, the compensating conductor 35 serves as a supply busbar at connecting point 40. Further short circuiting points are denoted by 42,43.

This way a first step in the heating up to operating temperature is achieved by short circuiting the conductor bars 33, 34 at places 42, 43.

A second electrical step in the heating up to operating temperature is achieved by short circuiting the cell at junction point 40.

The current is led from compensating conductor bar 35 of cell 10*a* to anodes 16 via preferably flexible conductor strips 36 and from anodes 16 of cell 10*a* via its cathodes to the next cell 10*b* in the manner described. The anodes 16 are attached to the anode suspension means 17 via a yoke 38.

The anode suspension facility 17 comprises, as shown in FIGS. 4, 5 a holding rod 23 around which a clamping sleeve 24 with inner thread can be moved. The end of the holding rod 23 facing the anode 16 features a notch 25 in which the yoke 38 is suspended and the conductor strip 36 is inserted. The clamping sleeve 24 is rotated downwards to secure the yoke 28 and strip 36 in place.

A further possibility for securing the yoke 28 and the conductor strip 36 to the anode suspension means 17 involves, as shown in FIG. 6, a sleeve 26 with a thread inside into which is inserted an extrusion billet 29 which has an outer thread and can be moved preferably by means of a motor or the like 27 and gear wheels 28. The sleeve 26 features a notch 25*a* in which the yoke 38 and the conductor strip 36 is inserted. By rotating the billet 29 both are held securely in place.

The breadth of the anode is chosen preferably such that it amounts to double the breadth of a carbon block 30. This causes the electric current to flow from two individual conductor bars 33 and 34 to one anode 16.

Figure 3:
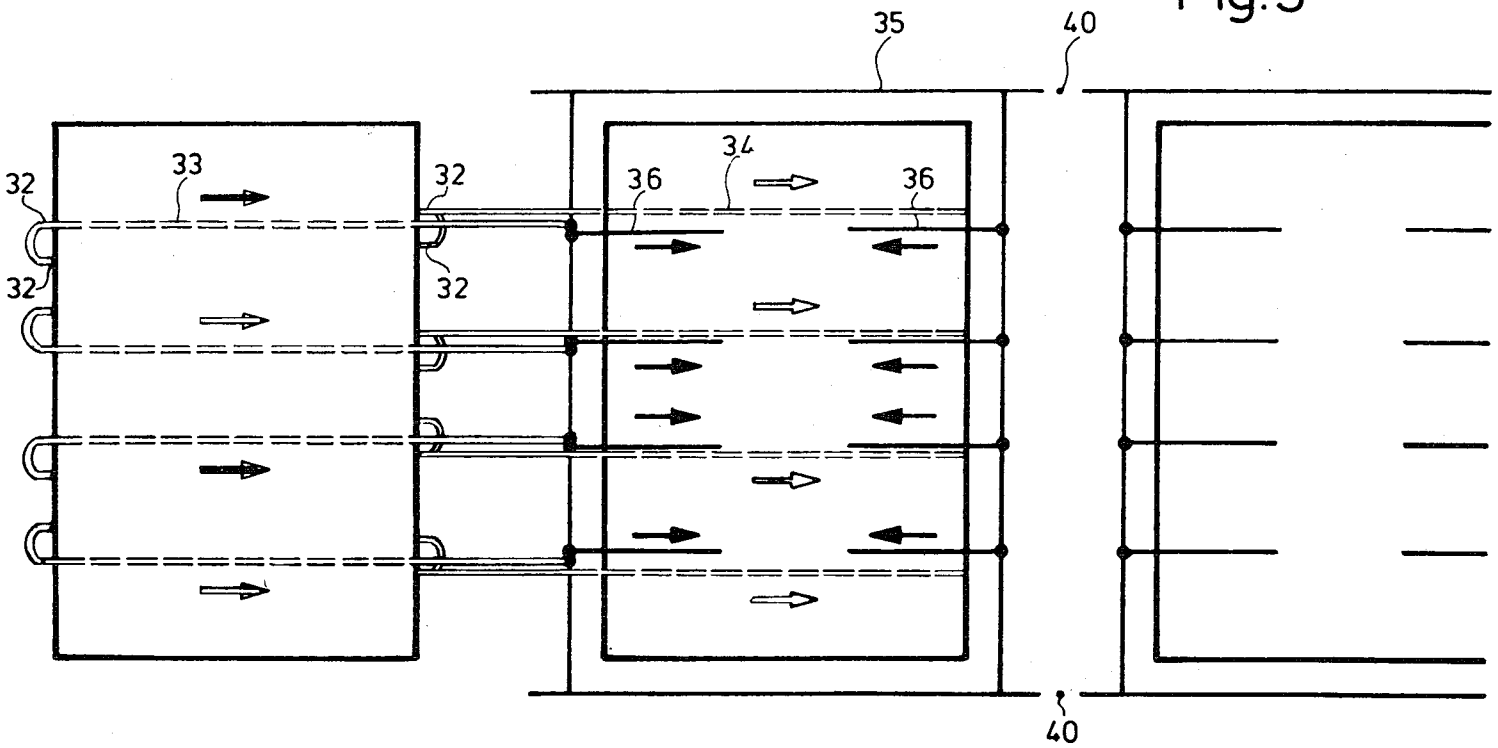
FIG. 3: A further version of the representation shown in FIG. 2.

However, two cathode bars 31 and 32 can, as shown in FIG. 3, also be connected at one long side of the cell 10 and led to the compensating conductor bar of cell 10*a*.

This means that two carbon blocks 30, each with two individual conductor bars 33 and 34 and two anodes 16, form one unit which can be provided in any numbers to give cells of different sizes.

The working surface 41 is between two electrolytic cells 10.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. An apparatus for conducting electrical current from the cathode to the anode of transversely disposed electrolytic cells comprising:

a first electrolytic cell having a cathode;

a second electrolytic cell having at least one anode and a compensating conductor bar, said at least one anode and said compensating conductor bar being in electrical contact;

said first electrolytic cell being provided with at least one cathode bar remote from said second electrolytic cell, at least one cathode bar proximate to said second electrolytic cell and at least one conductor bar passing under said first electrolytic cell, said at least one conductor bar having one end in electrical contact with said at least one cathode bar remote from said second electrolytic cell and the other end in electrical contact with said compensating conductor bar of said second electrolytic cell; and said second electrolytic cell being provided with at least one conductor bar passing under said second electrolytic cell, said at least one conductor bar having one end in electrical contact with said at least one cathode bar proximate to said second electrolytic cell and the other end in electrical contact with said compensating conductor bar of said second electrolytic cell.

2. An apparatus according to claim 1 wherein said compensating conductor bar is ring-shaped and extends around said second electrolytic cell at a height substantially equal to the height of the pot of said second electrolytic cell.

3. An apparatus according to claim 1 further including a flexible conductor strip leading from said compensating conductor bar to said at least one anode.

4. An apparatus according to claim 3 further including an anode holding device for suspending said at least one anode in said second electrolytic cell, said flexible conductor strip being in electrical contact with said anode holding device.

5. An apparatus according to claim 4 further including a yoke member secured to the uppermost surface of said at least one anode such that said flexible conductor strip is in electrical contact with said yoke.

6. An apparatus according to claim 5 wherein said anode holding device includes means for receiving said yoke and said flexible conductor strip.

7. An apparatus according to claim 6 wherein said means for receiving comprises a recess.

8. An apparatus according to claim 7 wherein said anode holding device includes a first element and a second element telescopically received within said first element, said first element and said second element being capable of movement relative to each other.

9. An apparatus according to claim 8 wherein said second element comprises a holding rod and said first element comprises a clamping sleeve for securing said flexible conductor strip in said recess between said yoke and said clamping sleeve.

10. An apparatus according to claim 9 wherein said first element is threadably received on said second element.

11. An apparatus according to claim 8 wherein said first element comprises a hollow holding rod and said second element comprises a clamping pin for securing said flexible conductor strip in said recess between said yoke and said clamping pin.

12. An apparatus according to claim 11 wherein said second element is threadably received in said first element.

13. An apparatus according to claim 1 wherein said first electrolytic cell is provided with a plurality of cathode bars remote from said second electrolytic cell, a plurality of cathode bars proximate to said electrolytic cell and a plurality of conductor bars equal in number to said plurality of cathode bars remote from said electrolytic cell wherein each of said plurality of conductor bars is in electrical contact with one of each of said plurality of cathode bars remote from said second electrolytic cell wherein all of said current is passed to said second electrolytic cell by said plurality of conductor bars.

* * * * *